US007380488B1

(12) United States Patent
Mao et al.

(10) Patent No.: US 7,380,488 B1
(45) Date of Patent: Jun. 3, 2008

(54) BLANK FIRING ADAPTER FOR COMBINATION GAS AND RECOIL OPERATED WEAPON

(75) Inventors: David C. C. Mao, Rockaway, NJ (US); Frank Dindl, Newton, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 176 days.

(21) Appl. No.: 11/164,933

(22) Filed: Dec. 12, 2005

Related U.S. Application Data

(60) Provisional application No. 60/593,144, filed on Dec. 15, 2004.

(51) Int. Cl.
*F41A 21/26* (2006.01)
*F41A 5/18* (2006.01)

(52) U.S. Cl. ..... 89/193; 89/29; 89/14.5; 42/77

(58) Field of Classification Search ..... 89/191.01, 89/191.02, 1.701, 1.702, 14.3, 29, 31, 14.5, 89/193; 42/1.06, 77
See application file for complete search history.

(56) References Cited

U.S. PATENT DOCUMENTS

| | | | | |
|---|---|---|---|---|
| 2,330,210 | A * | 9/1943 | Garand | 89/193 |
| 4,104,953 | A * | 8/1978 | Bard et al. | 89/14.5 |
| 4,261,246 | A * | 4/1981 | Skahill | 89/14.5 |
| 4,404,765 | A * | 9/1983 | Reudelsterz et al. | 42/77 |
| 5,983,772 | A * | 11/1999 | Reynolds et al. | 89/29 |
| 6,026,728 | A * | 2/2000 | Guhring et al. | 89/14.5 |
| 6,412,390 | B1 * | 7/2002 | Dindl | 89/14.5 |
| 6,848,208 | B1 * | 2/2005 | Kirschner | 42/77 |

* cited by examiner

*Primary Examiner*—Bret Hayes
(74) *Attorney, Agent, or Firm*—John F. Moran

(57) ABSTRACT

A firing adapter for a combination gas and recoil operated weapon includes a blank firing barrel attached to the weapon; a piston having a barrel end and an anchor end, the barrel end being reciprocably disposed in the blank firing barrel and the anchor end being fixed to a non-recoil surface; and a gas port formed in the blank firing barrel wherein in a rest position of the weapon, the barrel end of the piston closes the gas port, and in a recoil position of the weapon, the barrel end of the piston opens the gas port.

15 Claims, 5 Drawing Sheets

BLANK FIRING ADAPTER FOR COMBINATION GAS AND RECOIL OPERATED WEAPON

CROSS-REFERENCE TO RELATED APPLICATIONS

This application claims the benefit under 35 USC 119(e) of U.S. provisional patent application 60/593,144 filed on Dec. 15, 2004, which application is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to weapons and in particular to weapons that operate on a combination of gas and recoil.

Combination gas and recoil weapons are generally "automatic" or "semi-automatic." These weapons operate or function using ammunition recoil impulse and gas pressure. Combination gas and recoil operated weapons use gas pressure bled from the barrel during firing to power the gas system and ammunition recoil impulse for recoil operation. However, they may not operate properly when firing blank cartridges, limited range training rounds, non-lethal cartridges, and other low impulse cartridges. The reduced cartridge impulse provided by lower mass projectile systems and/or reduced chamber pressure results in reduced operating energy in the weapon. Consequently, the weapon cyclic rate may be reduced to the point of being non-functional.

Also, when trying to extract such low impulse cartridges from the weapon after firing, the cartridge case may get stuck in the weapon chamber, or the bolt may not unlock to extract the cartridge. This is due to the slower barrel recoil of the low impulse cartridges as compared to conventional ammunition. The low impulse cartridges also produce a longer duration of gas pressure in the chamber than do conventional ammunitions. The low impulse cartridges have high value for training and non-lethal operations, but lack the ability to effectively operate (function) the weapon.

SUMMARY OF THE INVENTION

It is an object of the invention to provide an apparatus for combination gas and recoil operated weapons that enables full functioning of such weapons when using low impulse cartridges.

Another object of the invention is to provide an apparatus for combination gas and recoil operated weapons that is safe to use when using low impulse cartridges.

A further object of the invention is to provide an apparatus for combination gas and recoil operated weapons that automatically vents gas from the barrel as the weapon recoils.

Still another object of the invention is to provide a blank firing adapter for combination gas and recoil operated weapons that is operable with a blank firing barrel and is inoperable with a live firing barrel.

One aspect of the invention is a firing adapter for a combination gas and recoil operated weapon, comprising a blank firing barrel attached to the weapon; a piston having a barrel end and an anchor end, the barrel end being reciprocably disposed in the blank firing barrel and the anchor end being fixed to a non-recoil surface; and a gas port formed in the blank firing barrel wherein in a rest position of the weapon, the barrel end of the piston closes the gas port, and in a recoil position of the weapon, the barrel end of the piston opens the gas port.

Preferably, the non-recoil surface is part of the weapon. In preferred embodiments of the invention, the inside diameter of the blank firing barrel and the outside diameter of the barrel end of the piston are substantially the same, such that the blank firing barrel and the barrel end of the piston form a slip fit.

In one embodiment, the length of the blank firing barrel is less than the length of the live firing barrel. Also, the barrel end of the piston includes a stop and, in the rest position of the weapon, a distance from the stop to a rear barrel mounting surface of the weapon is less than the length of the live firing barrel. In a preferred embodiment, the stop comprises a bend in the piston.

An advantageous feature of the invention comprises the barrel end of the piston having a length that is greater than a travel distance of the blank firing barrel from the rest position to the recoil position such that the barrel end of the piston is disposed in the blank firing barrel during a complete weapon cycle.

In an alternate embodiment, the blank firing barrel comprises a first portion having an inside diameter substantially the same as an outside diameter of the barrel end of the piston and a second portion having an inside diameter substantially greater than the outside diameter of the barrel end of the piston, the second portion of the blank firing barrel having an opening in the form of a longitudinal slot formed therein and the piston including an arm attached to the barrel end of the piston wherein the arm reciprocates in the slot as the barrel end reciprocates in the blank firing barrel.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
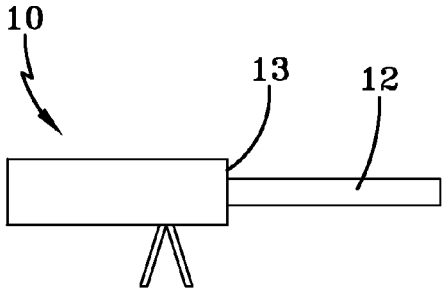
FIG-1 PRIOR ART
FIG. 1 is a schematic side view of a weapon.
Figure 1A:
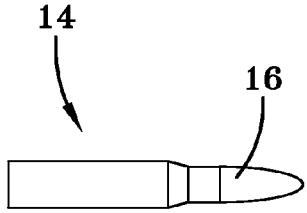
FIG-1A PRIOR ART
FIG. 1A is a schematic view of a live cartridge.

FIG. 1 is a schematic side view of a weapon 10. Weapon 10 is a combination gas and recoil operated weapon, that is, both gas pressure from the barrel 12 and recoil from the weapon are used to operate the weapon 10. Weapon 10 may be, for example, an automatic or semi-automatic weapon such as a machine gun. The "normal" barrel for the weapon 10 is a live firing barrel 12 used to fire live rounds having bullets. FIG. 1A shows an exemplary live round or cartridge 14 having a bullet or projectile 16. Weapon 10 has a rear barrel mounting surface 13 for attaching barrels.

Sometimes, it is desired to fire blank rounds from the weapon 10. The blank rounds do not launch a bullet or projectile and many do not create the gas pressure and/or recoil needed to operate the weapon 10. The present invention is a blank firing adapter that replaces the live firing barrel 12, when the weapon 10 is to be used with blank rounds.

Figure 2:
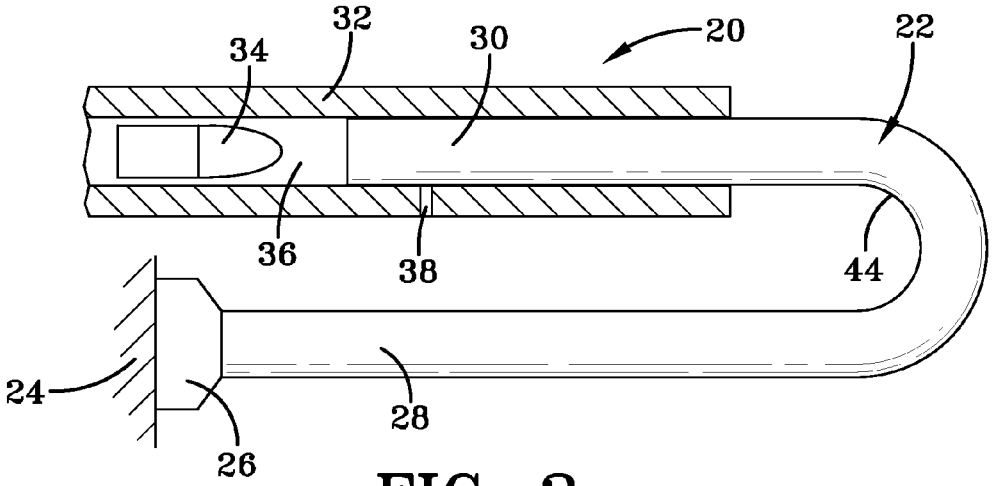
FIG. 2 is a schematic side view of one embodiment of a firing adapter.

FIG. 2 is a schematic side view of one embodiment of a blank firing adapter 20. Firing adapter 20 includes a blank firing barrel 32 attached to the weapon 10 and a piston 22 having a barrel end 30 and an anchor end 28 The barrel end 30 is reciprocably disposed in the blank firing barrel 32 and the anchor end 28 is fixed via anchor 26 to a non-recoil surface 24. The barrel end 30 of the piston 22 acts as a gas piston inside the blank firing barrel 32. Gas from the blank cartridge 34 fills the volume 36 in the barrel 32, forcing the barrel 32 and piston 22 apart to thereby powering the recoil operation. The piston 22 remains more or less stationary while the blank firing barrel 30 moves rearward during recoil (FIG. 3) and then back to the rest position of FIG. 2.

A gas port 38 is formed in the blank firing barrel 32. In the rest position of the weapon 10, the barrel end 30 of piston 22 closes the gas port 38, as shown in FIG. 2. In the recoil position of the weapon 10, the barrel end 30 of piston 22 opens the gas port 38 (FIG. 3) and gas in the barrel 32 is vented to the gas operating device (not shown) of the weapon 10. After recoil, the weapon 10 returns to the rest position shown in FIG. 2.

The non-recoil surface 24 may be any surface that is stationary when the weapon 10 recoils. In a preferred embodiment, the non-recoil surface 24 is a non-recoil part of weapon 10, for example, the receiver of the weapon 10. By anchoring the piston 22 to a non-recoil part of the weapon 10, the weapon 10 and the firing adapter 20 are freely mobile.

As shown in FIG. 2, the inside diameter of the blank firing barrel 32 and the outside diameter of the barrel end 30 of the piston 22 are "substantially" the same, although the outside diameter of the barrel end 30 must, of course, be a bit smaller than the inside diameter of the blank firing barrel 32 for it to reciprocate therein. The barrel end 30 of piston 22 and the blank firing barrel 32 form a slip fit, for example.

Figure 9:
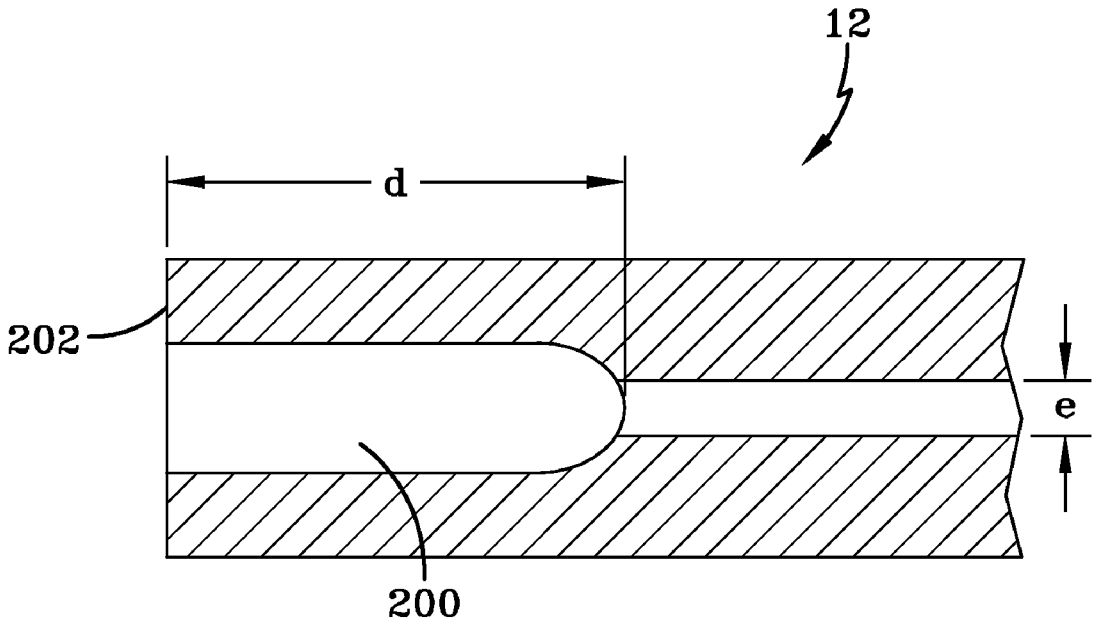
FIG. 9 shows a live firing barrel.

The force imparted to the piston 22 by the gas in the barrel may be varied by varying the inside diameter of the blank firing barrel 32 and consequently, the outside diameter of the piston 22. FIG. 9 is a schematic side view of a portion of a live firing barrel 12 having a chamber 200 at its breech end 202. Chamber 200 has a length d and live firing barrel 12 has an inside diameter e. In one embodiment, the inside diameter c (FIG. 4) of the blank firing barrel 32 is greater than the inside diameter e (FIG. 9) of the live firing barrel 12 such that the piston 22 becomes a "super" caliber piston. In another embodiment, the inside diameter c of the blank firing barrel 32 is less than the inside diameter e of the live firing barrel 12 such that the piston 22 becomes a "sub" caliber piston.

Figure 4:
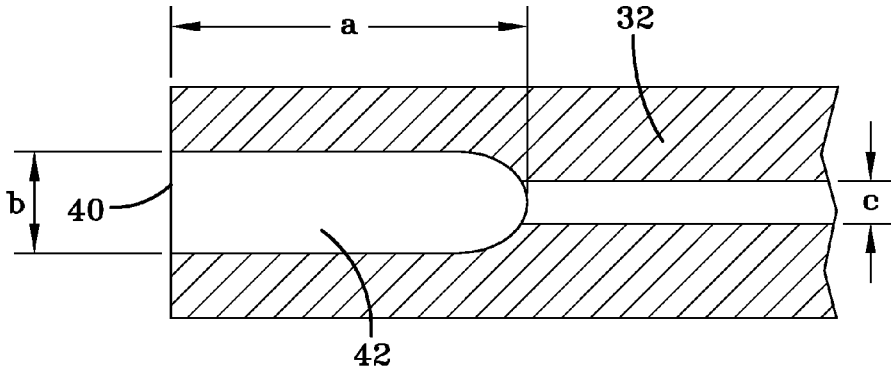
FIG. 4 is a schematic side section of a portion of a blank firing barrel.

FIG. 4 is a schematic side section of a portion of a blank firing barrel 32 having a chamber 42 at its breech end 40. Chamber 42 receives individual blank cartridges 34 (FIG. 2). For safety purposes, the chamber 42 has a length "a" that is shorter than the length of a live cartridge 14 (FIG. 1A) and the length d (FIG. 9) of the live fire chamber 200, to prevent using live cartridges therein. Also, the chamber may have a diameter "b" that is smaller than the diameter of a live cartridge 14, to prevent using live cartridges therein.

Figure 3:
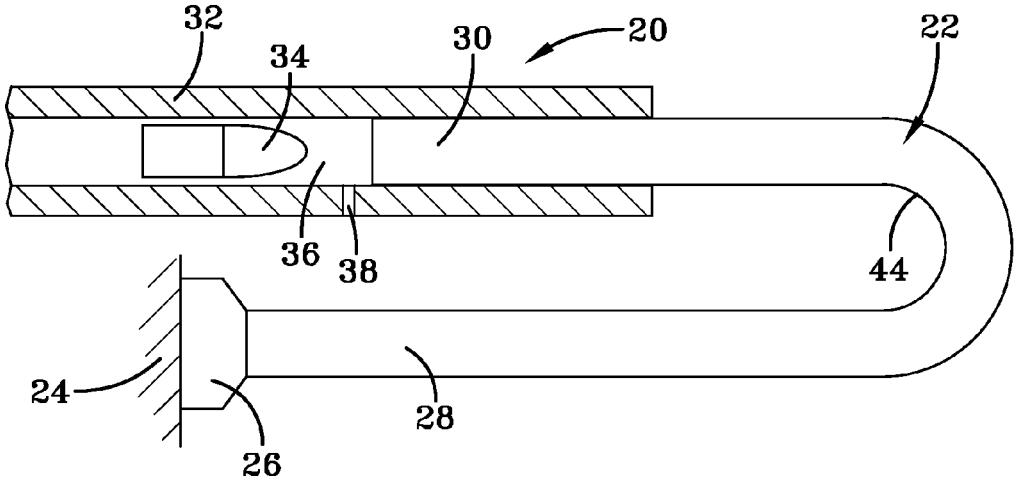
FIG. 3 shows the adapter of FIG. 3 in a recoil position.

Another safety feature is realized by, first, making the length of the blank firing barrel 32 less than the length of the live firing barrel 12. Then, the barrel end 30 of the piston 22 is provided with a stop 44 such that the muzzle end of the live firing barrel 12 butts against the stop 44 before reaching the rest position. The stop 44 could be, for example, a flange (not shown) surrounding the piston 22, or, as shown in FIGS. 2 and 3, the bend 44 in the piston 22 functions as the stop. That is, the muzzle end of a barrel can slide on barrel end 30 of piston 22 only up to bend 44, where it is stopped by the inner curved surface at the bend 44.

By using a blank firing barrel 32 that is shorter than the live firing barrel 12 and forming the stop 44 at the appropriate position on the barrel end 30 of the piston 22, it is not possible to use the piston 22 with the live firing barrel 12. This is so because the distance between the stop 44 and the rear mounting surface for a barrel is less than the length of the live firing barrel 12, when the weapon is in a rest position. This feature is most effective when the anchor end 28 of the piston 22 is attached to a non-recoil surface 24 of the weapon, such as the receiver. With the anchor end 28 attached to the weapon 10, the stop 44 is always the same distance from the rear mounting surface of the barrel, which distance is chosen to be shorter than the length of the live firing barrel 14.

A further safety feature relates to the length of the barrel end 30 of the piston 22. The barrel end 30 is made long enough so that it is always at least partially disposed in the blank firing barrel 32 during the complete weapon cycle (rest, firing, recoil, rest). The minimum length of the barrel end 30 of the piston 22 should be greater than the amount of travel of the muzzle end of the blank firing barrel 32 during a weapon cycle. The barrel end 30 of piston 22 will always be disposed in the barrel 32, which will prevent any objects from entering barrel 32.

As discussed above, the gas port 38 formed in the blank firing barrel 32 vents gas to the weapon operating system. It is possible that the gas produced by the blank cartridge 34 is more than needed. In such a case, the excess gas needs to be released out of the blank firing barrel 32. There are several ways to release the excess gas.

Figure 5A:
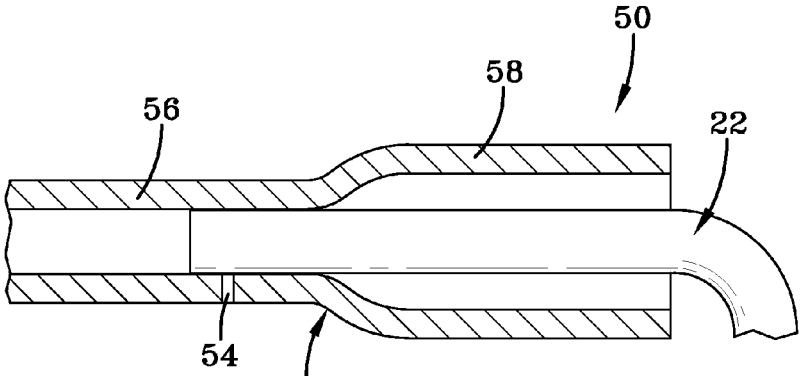
FIG. 5A is a schematic partial view of another embodiment of a firing adapter.
Figure 5B:
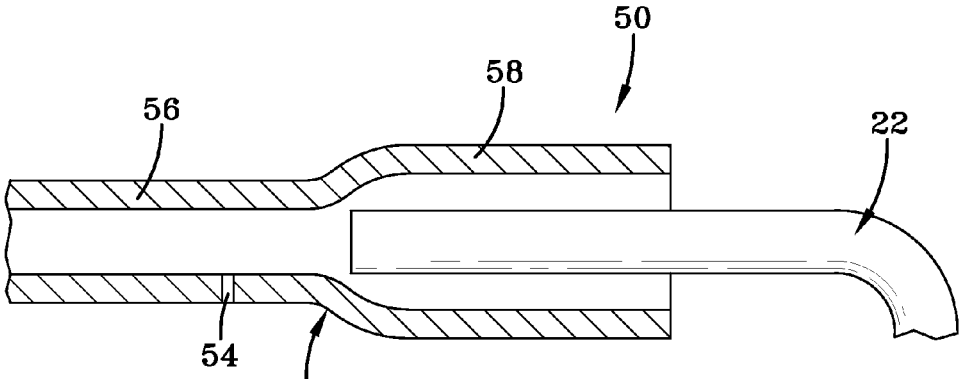
FIG. 5B shows the firing adaptor of FIG. 5A in a recoil position.

FIG. 5A shows an embodiment of a firing adaptor 50 in the rest position. FIG. 5B shows the firing adaptor 50 of FIG. 5A in a recoil position. The firing adapter 50 has a blank firing barrel 52 that comprises a first portion 56 and a second portion 58. First portion 56 has an inside diameter substantially the same as an outside diameter of the piston 22. Second portion 58 has an inside diameter that is substantially greater than the outside diameter of the piston 22. Therefore, gas may exit the barrel 50 by passing between piston 22 and second portion 58 when the barrel end of piston 22 is retracted from the first portion 56, as in the recoil position of FIG. 5B.

Piston 22 has a slip fit with first portion 56. The gas port 54 is formed in the first portion 56 so that, in a rest position, the piston 22 covers the gas port 54 and, in a recoil position, the piston 22 opens the gas port 54 so that gas in the barrel 50 is vented to the gas operating device (not shown) of the weapon. As the piston 22 continues to retract into the second portion 58, excess gas not needed by the gas operating device may exit out the end of the barrel via the space between second portion 58 and piston 22.

Figure 6A:
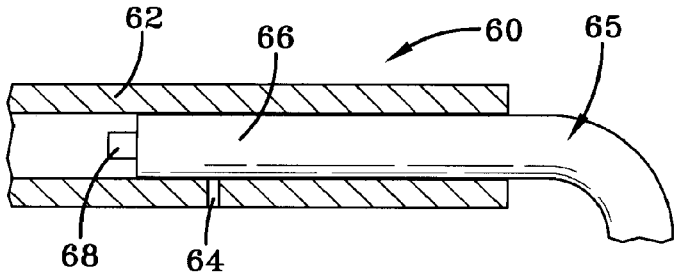
FIG. 6A shows another embodiment of a firing adaptor.
Figure 6B:
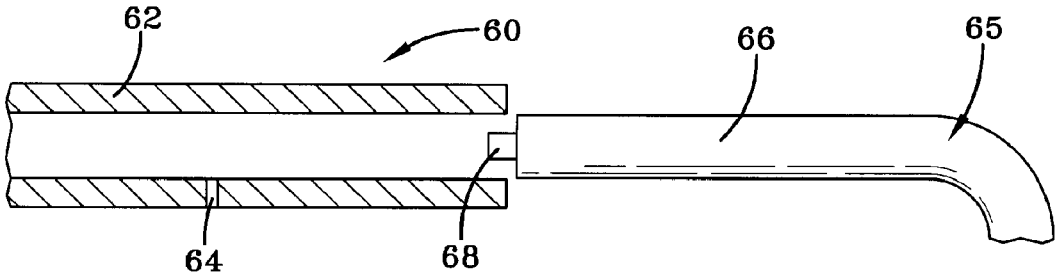
FIG. 6B shows the firing adaptor of FIG. 6A in a recoil position.

FIG. 6A shows another embodiment of a firing adaptor 60. FIG. 6B shows the firing adaptor of FIG. 6A in a recoil position. Firing adaptor 60 has a piston 65 that includes a first portion 66 and a second portion 68. The first portion 66 has an outside diameter substantially the same as an inside diameter of the blank firing barrel 62. The second portion 68 has an outside diameter that is substantially less than the inside diameter of the blank firing barrel 62. Therefore, gas may exit the barrel 62 via the space between barrel 62 and the second portion 68 of the piston 65, when the second portion 68 of the piston 65 begins to exit the muzzle of the barrel, as shown in FIG. 6B.

First portion 66 of piston 65 has a slip fit with barrel 62. The gas port 64 is formed in barrel 62 so that, in a rest position (FIG. 6A), the first portion 66 of piston 65 covers the gas port 64 and, in a recoil position (FIG. 6B), the first portion 66 of piston 65 opens the gas port 64. A part of the second portion 68 of piston 65 is disposed outside the blank firing barrel 62 in the recoil position so that gas may exit the barrel 62 around the reduced diameter second portion 68.

Figure 7A:
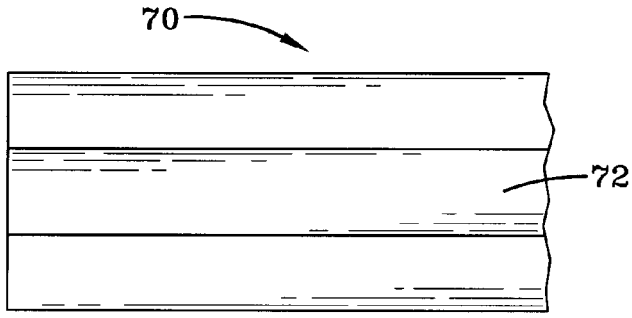
FIG. 7A is a side view of a piston.
Figure 7B:
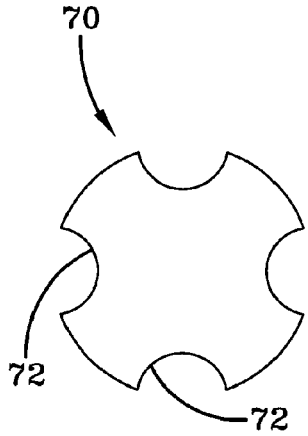
FIG. 7B is an end view of a piston.

Another way of venting excess gas is similar to firing adapter 60 of FIGS. 6A and 6B. However, the second portion 68 of piston 65 is replaced with a grooved portion 70 shown in a side view in FIG. 7A and an end view in FIG. 7B. The grooved portion 70 has at least one longitudinal groove 72 formed therein. A part of the grooved portion 70 is disposed outside the blank firing barrel in the recoil position, so that excess gas in the barrel may exit through the groove(s) 72.

Figure 8A:
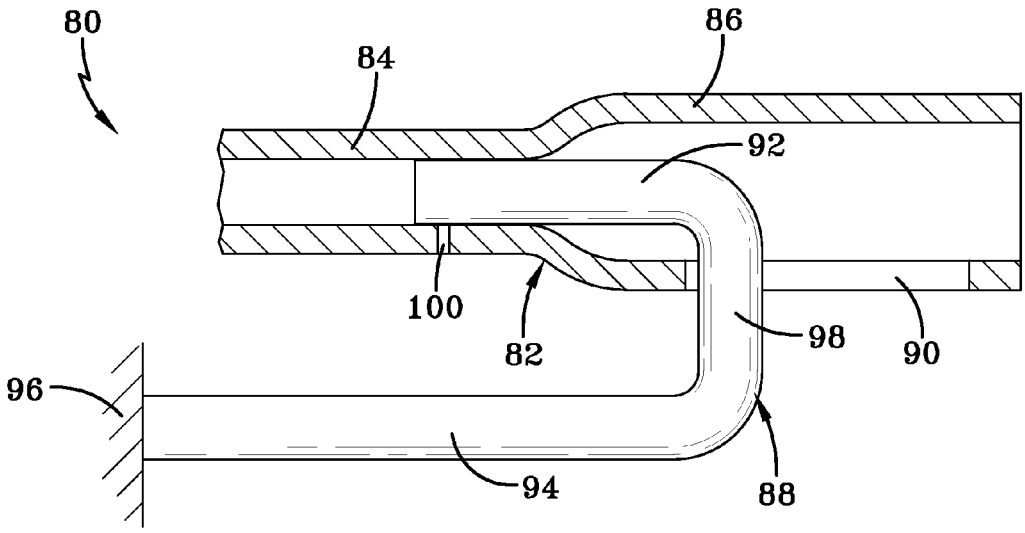
FIG. 8A shows another embodiment of a firing adapter in the rest positions.
Figure 8B:
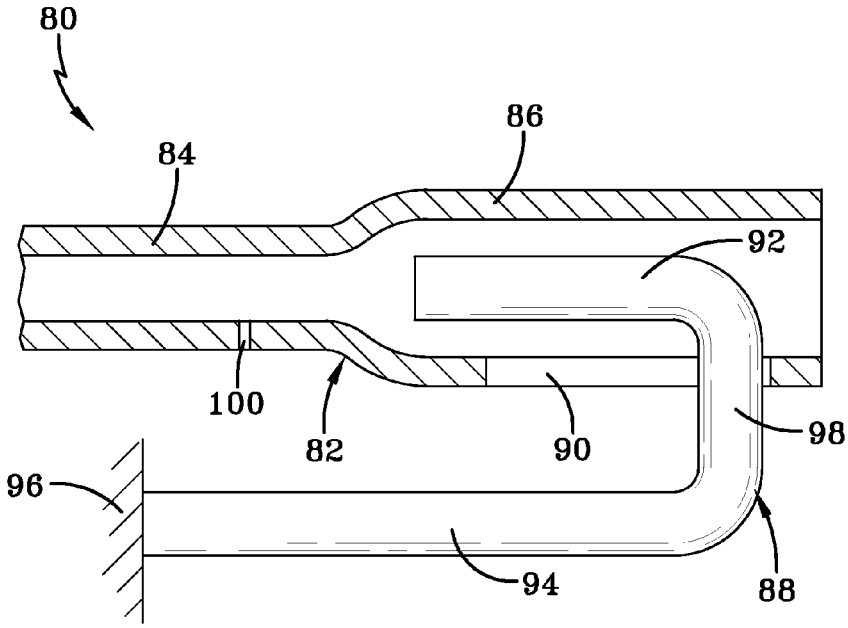
FIG. 8B shows the adapter of FIG. 8A in a recoil position.

FIGS. 8A and 8B show another embodiment of a firing adapter 80 in the rest and recoil positions, respectively. Firing adapter 80 comprises a blank firing barrel 82 and a piston 88. Blank firing barrel 82 comprises a first portion 84 and a second portion 86. Piston 88 comprises a barrel end 92, an anchor end 94 and an arm 98. The first portion 84 of barrel 82 has an inside diameter substantially the same as an outside diameter of the barrel end 92 of the piston 88. The second portion 86 of barrel 82 has an inside diameter substantially greater than the outside diameter of the barrel end 92 of the piston 88.

The barrel end 92 is reciprocably disposed in the blank firing barrel 82 and the anchor end 94 is fixed to a non-recoil surface 96. A gas port 100 is formed in the first portion 84 of the blank firing barrel 82. In a rest position of the weapon (FIG. 8A), the barrel end 92 of the piston 88 closes the gas port 100 and in a recoil position (FIG. 8B) of the weapon, the barrel end 92 of the piston 88 opens the gas port 100.

The second portion 86 of the blank firing barrel 82 includes an opening in the form of a longitudinal slot 90 formed therein. The arm 98 of piston 88 is attached to the barrel end 92 of the piston 88. The arm 98 reciprocates in the slot 90 as the barrel end 92 reciprocates in the blank firing barrel 82. As shown in FIG. 8B, in the recoil position, the barrel end 92 of piston 88 is removed from the first portion 84 of barrel 82 so that excess gas may exit the barrel via the space between barrel end 92 of piston 88 and barrel second portion 86.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A firing adapter for a combination gas and recoil operated weapon, comprising:

a blank firing barrel attached to the weapon;

a piston having a barrel end and an anchor end, the barrel end being reciprocably disposed in the blank firing barrel and the anchor end being fixed to a non-recoil surface; and a gas port formed in the blank firing barrel wherein in a rest position of the weapon, the barrel end of the piston closes the gas port, and in a recoil position of the weapon, the barrel end of the piston opens the gas port and further wherein an inside diameter of the blank firing barrel and an outside diameter of the barrel end of the piston are substantially the same, such that the blank firing barrel and the barrel end of the piston form a slip fit.

2. The firing adapter of claim wherein the non-recoil surface is part of the weapon.

3. The firing adapter of claim 1 wherein the inside diameter of the blank firing barrel is greater than an inside diameter of a live firing barrel for the weapon.

4. The firing adapter of claim 1 wherein the inside diameter of the blank firing barrel is less than an inside diameter of a live firing barrel for the weapon.

5. The firing adapter of claim 1 wherein the blank firing barrel comprises a chamber for receiving blank cartridges.

6. The firing adapter of claim 5 wherein the chamber is shorter than a length of a live cartridge, to prevent using live cartridges therein.

7. The firing adapter of claim 2 wherein a length of the blank firing barrel is less than a length of a live firing barrel.

8. The firing adapter of claim 7 wherein the barrel end of the piston includes a stop and further wherein, in the rest position of the weapon, a distance from the stop to a rear barrel mounting surface of the weapon is less than the length of the live firing barrel.

9. The firing adapter of claim 8 wherein the stop comprises a bend in the piston.

10. The firing adapter of claim 1 wherein the barrel end of the piston has a length that is greater than a travel distance of the blank firing barrel from the rest position to the recoil position such that the barrel end of the piston is disposed in the blank firing barrel during a complete weapon cycle.

11. The firing adapter of claim 1 wherein the blank firing barrel includes a first portion having an inside diameter substantially the same as an outside diameter of the barrel end of the piston and a second portion having an inside diameter that is substantially greater than the outside diameter of the barrel end of the piston, the gas port being formed in the first portion.

12. The firing adapter of claim 1 wherein the barrel end of the piston includes a first portion having an outside diameter substantially the same as an inside diameter of the blank firing barrel and a second portion having an outside diameter that is substantially less than the inside diameter of the blank firing barrel wherein at least a part of the second portion is disposed outside the blank firing barrel in the recoil position.

13. A firing adapter for a combination gas and recoil operated weapon, comprising:

a blank firing barrel attached to the weapon;

a piston having a barrel end and an anchor end, the barrel end being reciprocably disposed in the blank firing barrel and the anchor end being fixed to a non-recoil surface; and a gas port formed in the blank firing barrel wherein in a rest position of the weapon, the barrel end of the piston closes the gas port, and in a recoil position of the weapon, the barrel end of the piston opens the gas port and further wherein the barrel end of the piston has an outside diameter substantially the same as an inside diameter of the blank firing barrel, the barrel end including a grooved portion having at least one longitudinal groove formed therein wherein at least a part of the grooved portion is disposed outside the blank firing barrel in the recoil position.

14. A firing adapter for a combination gas and recoil operated weapon, comprising:

a blank firing barrel attached to the weapon;

a piston having a barrel end and an anchor end, the barrel end being reciprocably disposed in the blank firing barrel and the anchor end being fixed to a non-recoil surface; and a gas port formed in the blank firing barrel wherein in a rest position of the weapon, the barrel end of the piston closes the gas port, and in a recoil position of the weapon, the barrel end of the piston opens the gas port and further wherein the blank firing barrel comprises a first portion having an inside diameter substantially the same as an outside diameter of the barrel end of the piston and a second portion having an inside diameter substantially greater than the outside diameter of the barrel end of the piston, the second portion of the blank firing barrel having an opening in the form of a longitudinal slot formed therein and the piston including an arm attached to the barrel end of the piston wherein the arm reciprocates in the slot as the barrel end reciprocates in the blank firing barrel.

15. The firing adapter of claim 14 wherein the gas port is disposed in the first portion of the blank firing barrel.

* * * * *